US011241094B2

(12) United States Patent
Murphy

(10) Patent No.: US 11,241,094 B2
(45) Date of Patent: Feb. 8, 2022

(54) RECLINING HIGH-LEG SEATING UNIT

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 16/920,968

(22) Filed: Jul. 6, 2020

(65) Prior Publication Data

US 2020/0329870 A1 Oct. 22, 2020

Related U.S. Application Data

(63) Continuation of application No. 15/806,476, filed on Nov. 8, 2017, now Pat. No. 10,709,246.

(60) Provisional application No. 62/450,885, filed on Jan. 26, 2017.

(51) Int. Cl.

| | |
|---|---|
| ***A47C 1/02*** | (2006.01) |
| ***A47C 1/024*** | (2006.01) |
| ***A47C 1/032*** | (2006.01) |
| ***A47C 1/035*** | (2006.01) |
| ***A47C 1/0355*** | (2013.01) |
| ***A47C 1/034*** | (2006.01) |
| ***A47C 3/18*** | (2006.01) |

(Continued)

(52) U.S. Cl.

CPC ..... *A47C 1/0345* (2013.01); *A47C 3/0255* (2013.01); *A47C 3/18* (2013.01); *A47C 3/02* (2013.01)

(58) Field of Classification Search

CPC ..... A47C 3/02; A47C 3/0255; A47C 1/0345; A47C 3/18

USPC ..... 297/83–85 R

See application file for complete search history.

(56) References Cited

U.S. PATENT DOCUMENTS

| | | | |
|---|---|---|---|
| 3,087,757 | A | 4/1963 | Fidel |
| 3,141,700 | A | 7/1964 | Fletcher |
| 3,337,267 | A | 8/1967 | Rogers, Jr. |

(Continued)

FOREIGN PATENT DOCUMENTS

| | | |
|---|---|---|
| JP | 2012016992 | 1/2012 |
| WO | 9729725 A1 | 8/1997 |

OTHER PUBLICATIONS

Extended European Search Report corresponding to European Application No. 17894301.5 dated Mar. 27, 2020.

(Continued)

*Primary Examiner* — Rodney B White

(74) *Attorney, Agent, or Firm* — Myers Bigel, P.A.

(57) ABSTRACT

An elevated mount chair includes: a base; a pair of arms; a seat positioned above the base between the arms; a backrest; a first ottoman; a reclining mechanism attached to the base, the seat and the backrest; and a footrest mechanism attached to the seat and the first ottoman, the footrest mechanism being coupled to the reclining mechanism. The seat includes a T-cushion positioned above a seat frame, the T-cushion having lateral wings that are positioned forward of the arms. The reclining and footrest mechanisms comprise a plurality of pivotally interconnected links configured to move the chair between an upright position, a TV position, and a fully reclined position. In moving between the upright, TV and fully reclined positions, a front portion of the seat experiences substantially no forward or rearward movement relative to the arms.

12 Claims, 16 Drawing Sheets

(51) Int. Cl.
*A47C 3/025* (2006.01)
*A47C 3/02* (2006.01)

(56) References Cited

U.S. PATENT DOCUMENTS

| | | | |
|---|---|---|---|
| 3,522,969 | A | 8/1970 | Re |
| 3,869,169 | A | 3/1975 | Johnson et al. |
| 3,941,417 | A | 3/1976 | Re |
| 4,072,342 | A | 2/1978 | Johnson et al. |
| 4,185,869 | A | 1/1980 | Rogers, Jr. |
| 4,212,494 | A | 7/1980 | Dabney |
| 4,270,796 | A | 9/1981 | Preston |
| 4,307,912 | A | 12/1981 | Watt |
| 4,332,417 | A | 6/1982 | Mizelle |
| 4,350,387 | A | 9/1982 | Rogers, Jr. |
| 4,506,925 | A | 3/1985 | Crum |
| 4,662,673 | A | 5/1987 | Crum |
| 4,815,788 | A | 3/1989 | May |
| 4,878,710 | A | 11/1989 | Tacker |
| 4,904,019 | A | 2/1990 | May |
| 4,915,444 | A | 4/1990 | Rogers, Jr. |
| 4,989,914 | A | 2/1991 | Pine |
| 4,993,777 | A | 2/1991 | Lapointe |
| 5,013,084 | A | 5/1991 | May |
| 5,072,988 | A | 12/1991 | Plunk |
| 5,087,094 | A | 2/1992 | Rogers, Jr. |
| 5,088,789 | A | 2/1992 | LaPointe et al. |
| 5,090,768 | A | 2/1992 | Re et al. |
| 5,110,179 | A | 5/1992 | Rogers |
| 5,169,208 | A | 12/1992 | Re et al. |
| 5,354,116 | A | 10/1994 | May et al. |
| 5,360,255 | A | 11/1994 | Cook |
| 5,368,366 | A | 11/1994 | Mizelle |
| 5,374,101 | A | 12/1994 | Wiecek |
| 5,480,213 | A | 1/1996 | Sproule |
| 5,556,158 | A | 9/1996 | Wiecek |
| 5,588,710 | A | 12/1996 | Wiecek |
| 5,651,580 | A | 7/1997 | LaPointe et al. |
| 5,730,494 | A | 3/1998 | LaPointe et al. |
| 5,772,278 | A | 6/1998 | Kowalski |
| 5,775,775 | A | 7/1998 | Hoffman |
| 5,800,010 | A | 9/1998 | May |
| 5,823,614 | A | 10/1998 | Johnson et al. |
| 5,971,475 | A | 10/1999 | Lawson |
| 5,975,627 | A | 11/1999 | LaPointe et al. |
| 5,992,930 | A | 11/1999 | LaPointe et al. |
| 6,000,758 | A | 12/1999 | Schaffner et al. |
| 6,089,660 | A | 7/2000 | Sproule |
| 6,142,558 | A | 11/2000 | May |
| 6,540,291 | B2 | 4/2003 | Hoffman et al. |
| 6,729,686 | B2 | 5/2004 | May |
| 6,793,279 | B2 | 9/2004 | Hoffman et al. |
| 7,357,450 | B2 | 4/2008 | Clark |
| 7,396,074 | B2 | 7/2008 | Wiecek |
| 7,445,278 | B2 | 11/2008 | Wiecek |
| 7,445,279 | B2 | 11/2008 | Crum |
| 7,540,565 | B2 | 6/2009 | Lipford |
| 7,594,694 | B2 | 9/2009 | Wiecek |
| 7,641,277 | B2 | 1/2010 | Lawson et al. |
| 7,669,921 | B2 | 3/2010 | Hoffman et al. |
| 7,669,922 | B2 | 3/2010 | Murphy et al. |
| 7,673,933 | B2 | 3/2010 | Lawson |
| 7,762,625 | B2 | 7/2010 | Hoffman |
| 7,766,421 | B2 | 8/2010 | Lawson |
| 7,997,644 | B2 | 8/2011 | Hoffman et al. |
| 8,016,348 | B2 | 9/2011 | Hoffman et al. |
| 8,113,574 | B2 | 2/2012 | Hoffman et al. |
| 8,123,288 | B2 | 2/2012 | Murphy et al. |
| 8,297,693 | B2 | 10/2012 | Hoffman et al. |
| 8,360,515 | B2 | 1/2013 | Crum |
| 8,398,165 | B2 | 3/2013 | Lawson |
| 8,419,122 | B2 | 4/2013 | Lawson et al. |
| 8,459,733 | B2 | 6/2013 | Hoffman et al. |
| 8,783,764 | B2 | 7/2014 | Murphy et al. |
| 9,022,473 | B2 | 5/2015 | Crum |
| 9,326,608 | B1 | 5/2016 | Hoy et al. |
| 10,709,246 | B2 * | 7/2020 | Murphy ..... A47C 3/0255 |
| 2001/0035668 | A1 | 11/2001 | Gaffney et al. |
| 2002/0149238 | A1 | 10/2002 | Hoffman |
| 2003/0057743 | A1 | 3/2003 | May |
| 2006/0290174 | A1 | 12/2006 | Hoffman et al. |
| 2007/0126267 | A1 | 6/2007 | Hoffman et al. |
| 2008/0001455 | A1 | 1/2008 | Gong et al. |
| 2008/0012396 | A1 | 1/2008 | Hoffman et al. |
| 2009/0278395 | A1 | 11/2009 | Pollard et al. |
| 2010/0264702 | A1 | 10/2010 | Hoffman et al. |
| 2010/0283297 | A1 | 11/2010 | Crum |
| 2011/0175426 | A1 | 7/2011 | Lawson |
| 2011/0233972 | A1 | 9/2011 | Wiecek |
| 2011/0291460 | A1 | 12/2011 | Murphy et al. |
| 2011/0304193 | A1 | 12/2011 | Murphy et al. |
| 2012/0049606 | A1 | 3/2012 | Lawson et al. |
| 2012/0104827 | A1 | 5/2012 | Murphy et al. |
| 2012/0112519 | A1 | 5/2012 | Murphy et al. |
| 2012/0146364 | A1 | 6/2012 | Hoffman et al. |
| 2012/0153704 | A1 | 6/2012 | Hoffman et al. |
| 2012/0235449 | A1 | 9/2012 | Wiecek |
| 2012/0299363 | A1 | 11/2012 | Crum |
| 2013/0038095 | A1 | 2/2013 | Lawson et al. |
| 2013/0200659 | A1 | 8/2013 | Hoffman et al. |
| 2014/0327282 | A1 | 11/2014 | Crum |
| 2014/0333099 | A1 | 11/2014 | Lu et al. |
| 2015/0021959 | A1 | 1/2015 | Garland |
| 2015/0282619 | A1 | 10/2015 | Lawson |
| 2015/0289655 | A1 | 10/2015 | Lawson |
| 2016/0088942 | A1 | 3/2016 | Murphy |
| 2016/0332541 | A1 | 11/2016 | Bowen et al. |
| 2016/0346143 | A1 | 12/2016 | White et al. |
| 2018/0094711 | A1 | 4/2018 | Lawson et al. |

OTHER PUBLICATIONS

International Preliminary Report on Patentability corresponding to International Application No. PCT/US2017/059454 dated Jun. 27, 2019.

Notification of Transmittal of the International Search Report and the Written Opinion of the International Searching Authority, or the Declaration corresponding to International Application No. PCT/US2017/059454 dated Feb. 26, 2018.

Notification of Transmittal of the International Search Report and the Written Opinion of the International Searching Authority, or the Declaration corresponding to International Application No. PCT/US2017/060264 dated Feb. 14, 2018.

"Office Action corresponding to Canadian Application No. 3,046,311 dated Nov. 9, 2020".

"Office Action corresponding to Canadian Application No. 3,046,631 dated Sep. 30, 2020".

"Office Action corresponding to Chinese Application No. 201780084875.6 dated Oct. 11, 2011".

* cited by examiner

RECLINING HIGH-LEG SEATING UNIT

RELATED APPLICATIONS

This application is a continuation of and claims priority to U.S. patent application Ser. No. 15/806,476, filed Nov. 8, 2017, now U.S. Pat. No. 10,709,246, which claims the benefit of U.S. Provisional Patent Application No. 62/450,885, filed Jan. 26, 2017, the disclosures of which are hereby incorporated herein in their entirety.

FIELD OF THE INVENTION

The present invention relates generally to seating units, and relates more particularly to reclining seating units.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest that provides support for the occupant's feet in the reclined position.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor. In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability.

Nevertheless, some reclining mechanisms are not well-suited for certain chair styles. As an example, some reclining chairs have "T-shaped" cushions (often termed "T-cushions") that have laterally projecting wings positioned in front of the chair's arms. If the recliner chair is configured such that the seat moves rearwardly relative to the arms when moving to the TV or reclined positions, the wings on the T-cushion can catch on the front of the arms prevent the cushion from moving with the seat, such that the cushion is improperly positioned relative to the backrest. The T-cushion may also be mispositioned if the lower end of the backrest separates significantly from the rear end of the seat.

As another example of a chair that presents some difficulty for reclining mechanisms, some chairs have a "high leg" style in which the arms of the chair are raised several inches off of the underlying surface (typically between about 4 and 9 inches). It is ordinarily undesirable for portions of a reclining mechanism to be visible in the space below the chair when the chair is in the upright position, so the designers are faced with providing a reclining mechanism that folds into a relatively small package.

It would be desirable to provide chairs that address some of these needs.

SUMMARY

As a first aspect, embodiments of the invention are directed to an elevated mount chair comprising: a base; a pair of arms; a seat positioned above the base between the arms; a backrest; a first ottoman; a reclining mechanism attached to the base, the seat and the backrest; and a footrest mechanism attached to the seat and the first ottoman, the footrest mechanism being coupled to the reclining mechanism. The seat includes a T-cushion positioned above a seat frame, the T-cushion having lateral wings that are positioned forward of the arms. The reclining and footrest mechanisms comprise a plurality of pivotally interconnected links configured to move the chair between (a) an upright position, in which the backrest is disposed at a first generally upright backrest angle, the seat is disposed at a first generally horizontal seat angle, and the first ottoman is retracted below a forward portion of the seat, (b) a TV position, in which the backrest substantially maintains the first backrest angle, the seat is disposed at a second seat angle that is steeper than the first seat angle; and the first ottoman is extended in front of the seat and is generally horizontally disposed, and (c) a fully reclined position, in which the backrest is disposed at a second backrest angle that is shallower than the first backrest angle, and the first ottoman remains extended in front of the seat. In moving between the upright, TV and fully reclined positions, a front portion of the seat experiences substantially no forward or rearward movement relative to the arms.

As a second aspect, embodiments of the invention are directed to an elevated mount chair comprising: a base; a pair of arms; a seat positioned above the base between the arms; a backrest; a first ottoman; a reclining mechanism attached to the base, the seat and the backrest; and a footrest mechanism attached to the seat and the first ottoman, the footrest mechanism being coupled to the reclining mechanism. The seat includes a T-cushion positioned above a seat frame, the T-cushion having lateral wings that are positioned forward of the arms. The reclining and footrest mechanisms comprise a plurality of pivotally interconnected links configured to move the chair between (a) an upright position, in which the backrest is disposed at a first generally upright backrest angle, the seat is disposed at a first generally horizontal seat angle, and the first ottoman is retracted below a forward portion of the seat, (b) a TV position, in which the backrest substantially maintains the first backrest angle, the seat is disposed at a second seat angle that is steeper than the first seat angle; and the first ottoman is extended in front of the seat and is generally horizontally disposed, and (c) a fully reclined position, in which the backrest is disposed at a second backrest angle that is shallower than the first backrest angle, and the first ottoman remains extended in front of the seat. In the upright position, a lowermost portion of the reclining and footrest mechanisms is between about 5 and 7 inches from an uppermost portion of the seat frame.

DETAILED DESCRIPTION OF EMBODIMENTS OF THE INVENTION

Figure 1:
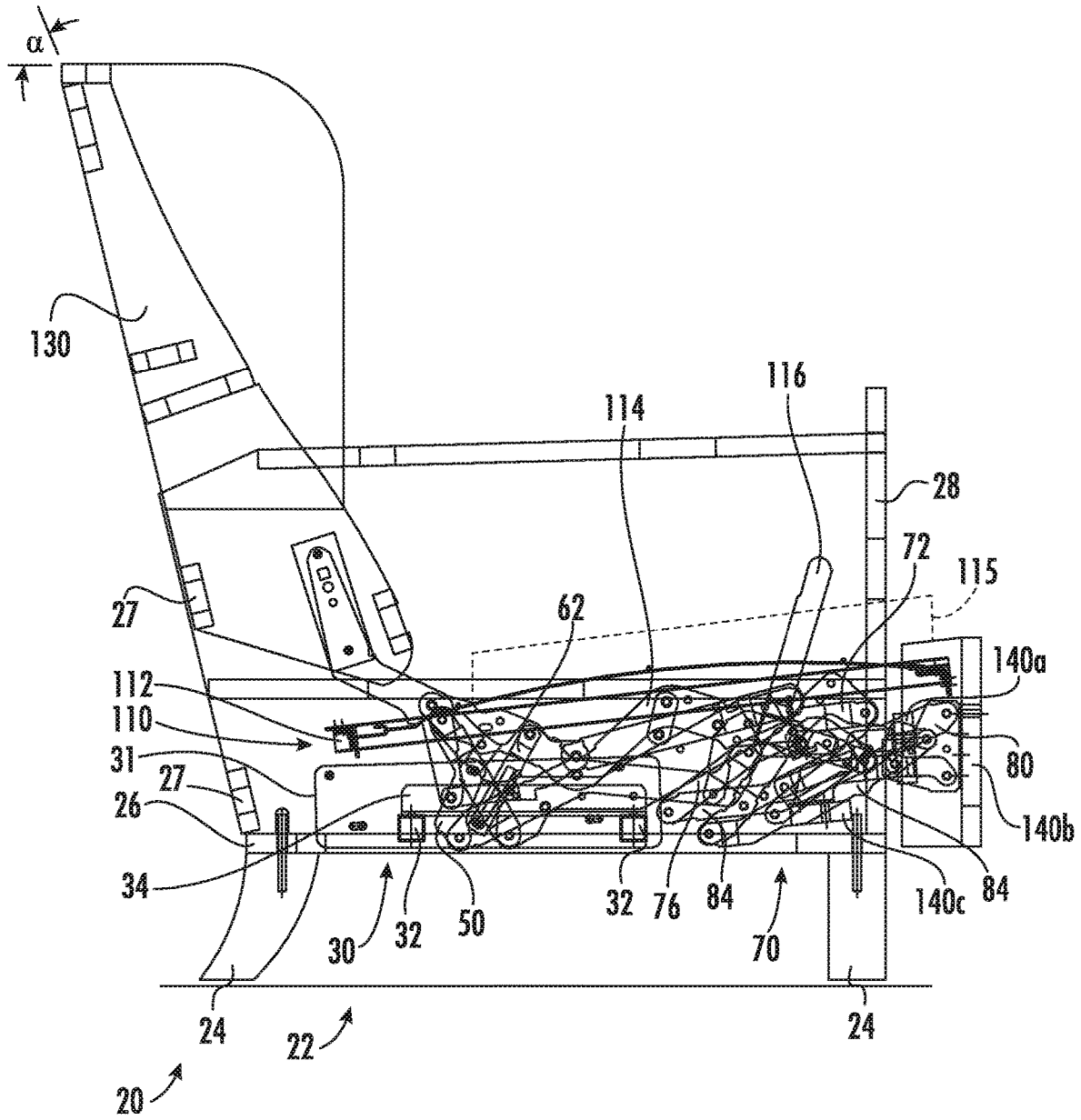
FIG. 1 is a side view of a high-leg reclining chair according to embodiments of the invention shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul. Kinematics and Dynamics of Planar Machinery 4-21 (1979).

Figure 2:
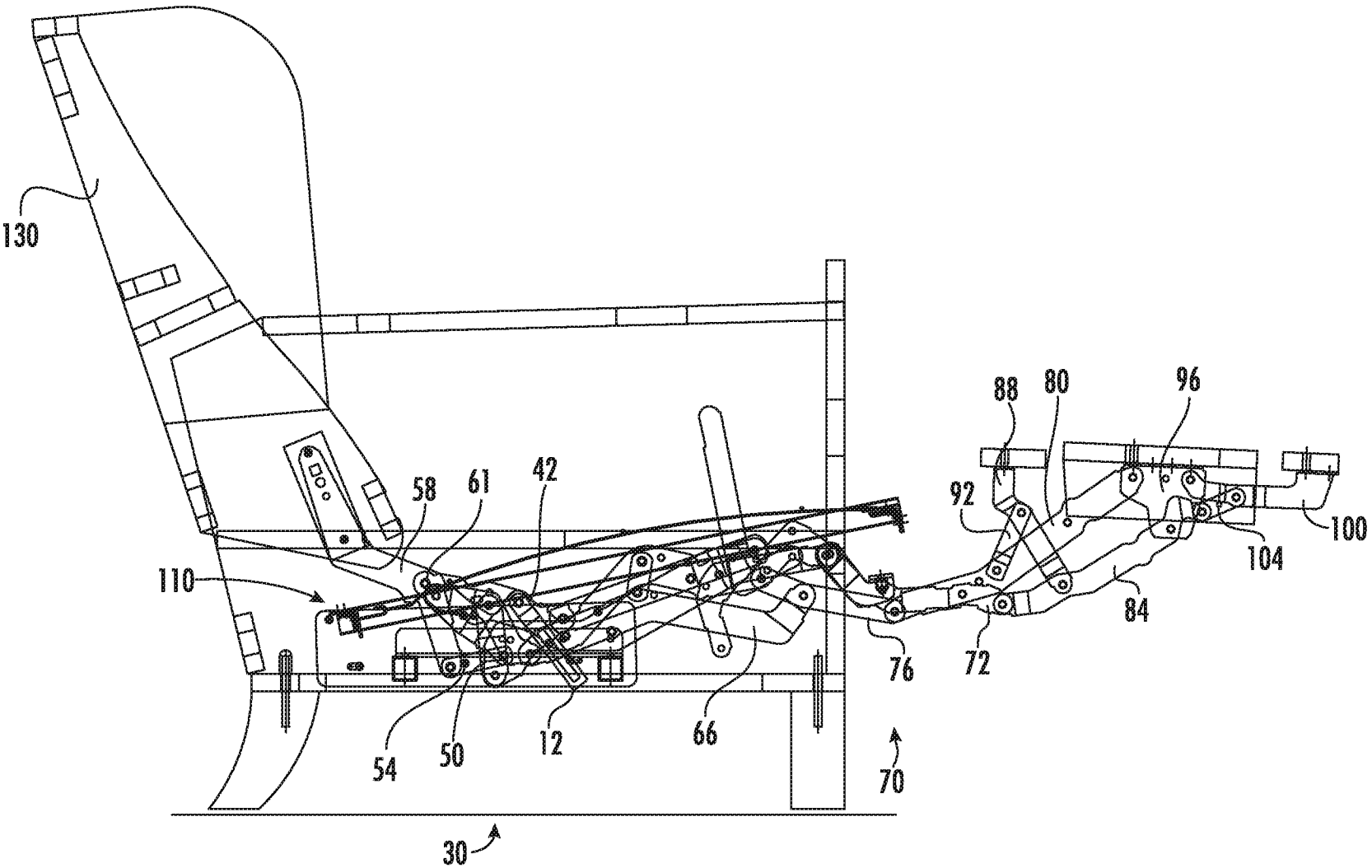
FIG. 2 is a side view of the chair of FIG. 1 shown in the TV position.
Figure 3:
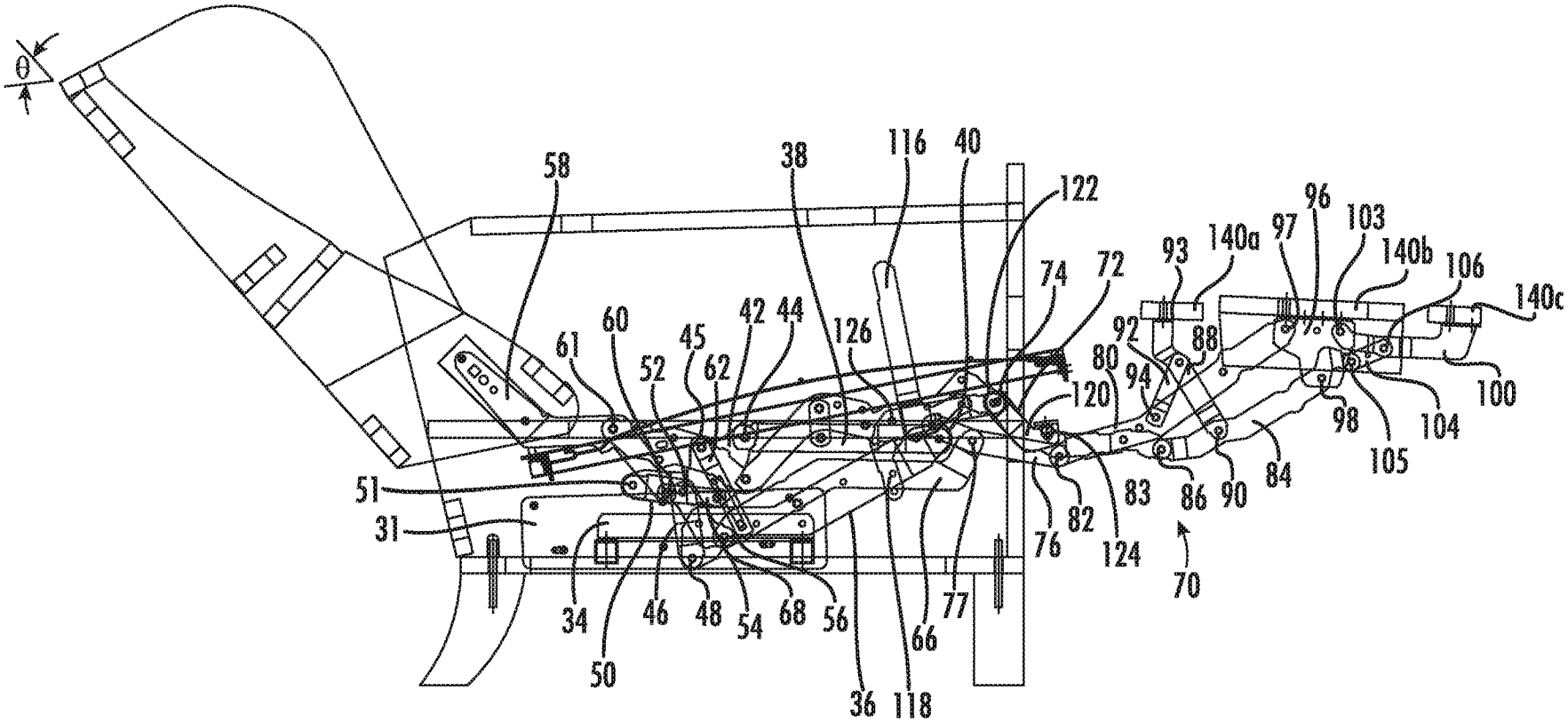
FIG. 3 is a side view of the chair of FIG. 1 shown in the fully reclined position.
Figure 5:
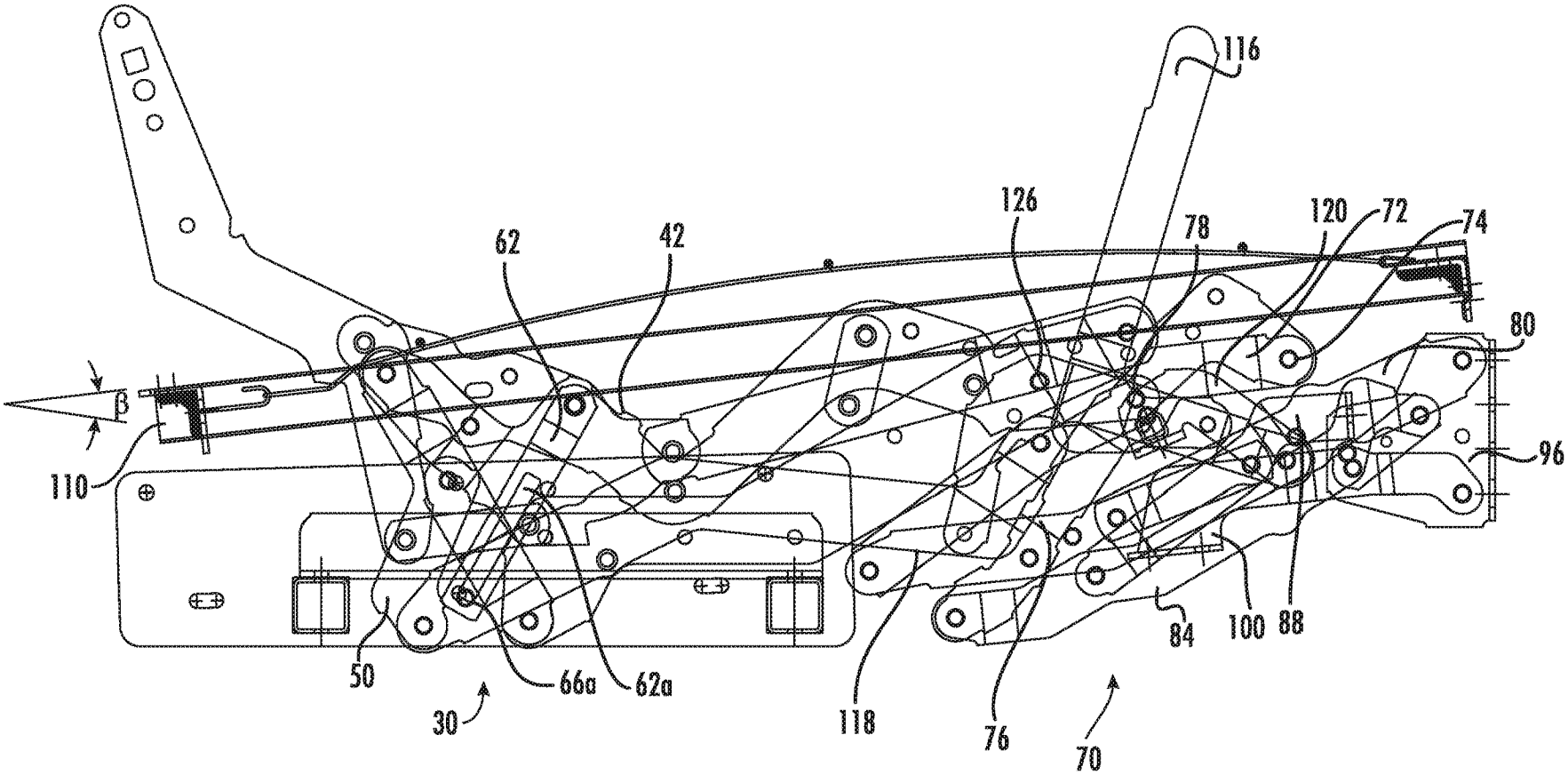
FIG. 5 is a side view of the reclining and footrest mechanisms of the seating unit of FIG. 1 shown in the upright position.
Figure 6:
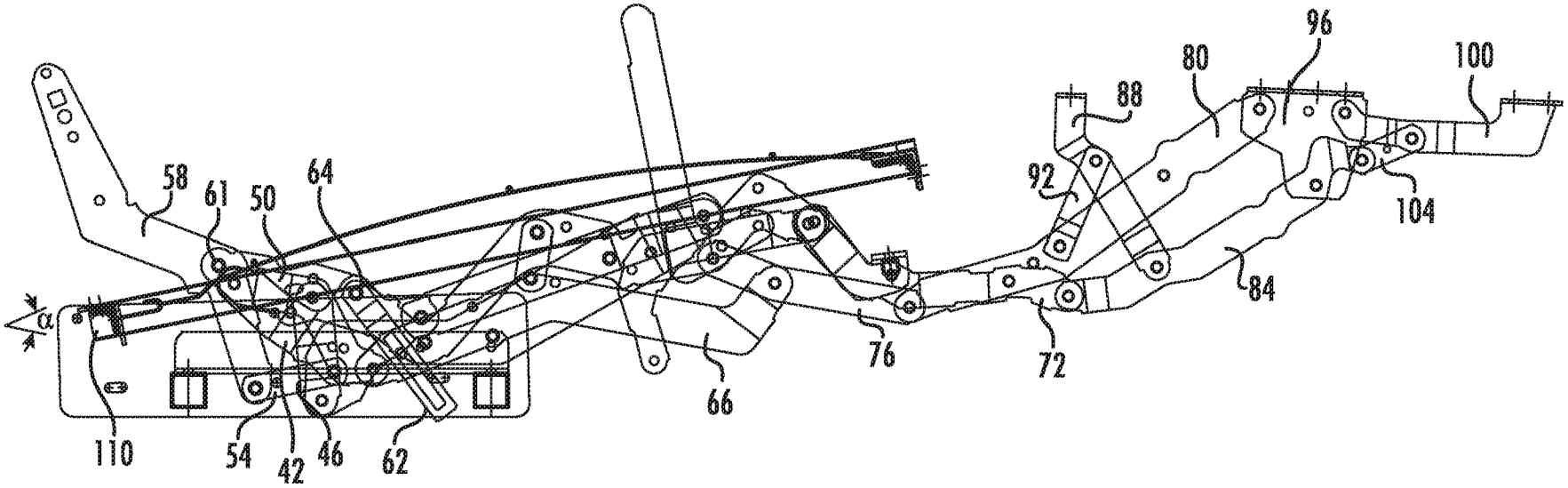
FIG. 6 is a side view of the reclining and footrest mechanisms of the seating unit of FIG. 1 shown in the TV position.
Figure 7:
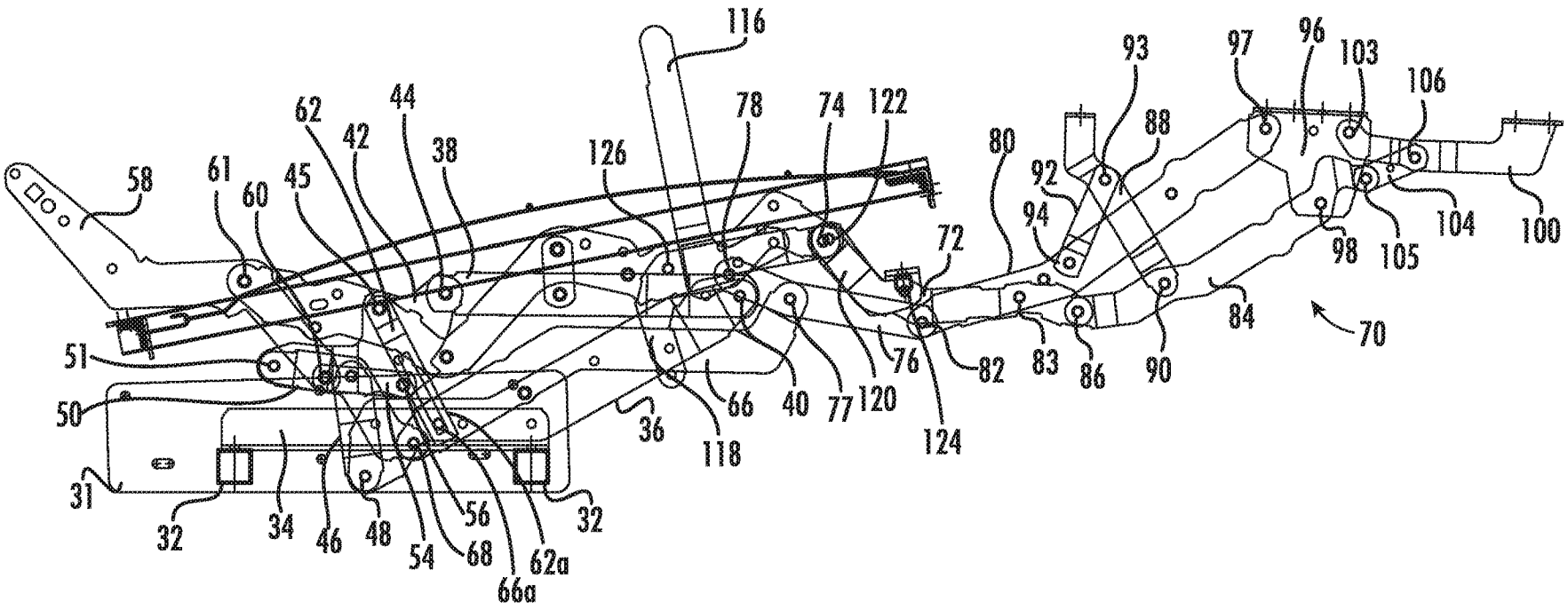
FIG. 7 is a side view of the reclining and footrest mechanisms of the seating unit of of FIG. 1 shown in the fully reclined position.
Figure 8:
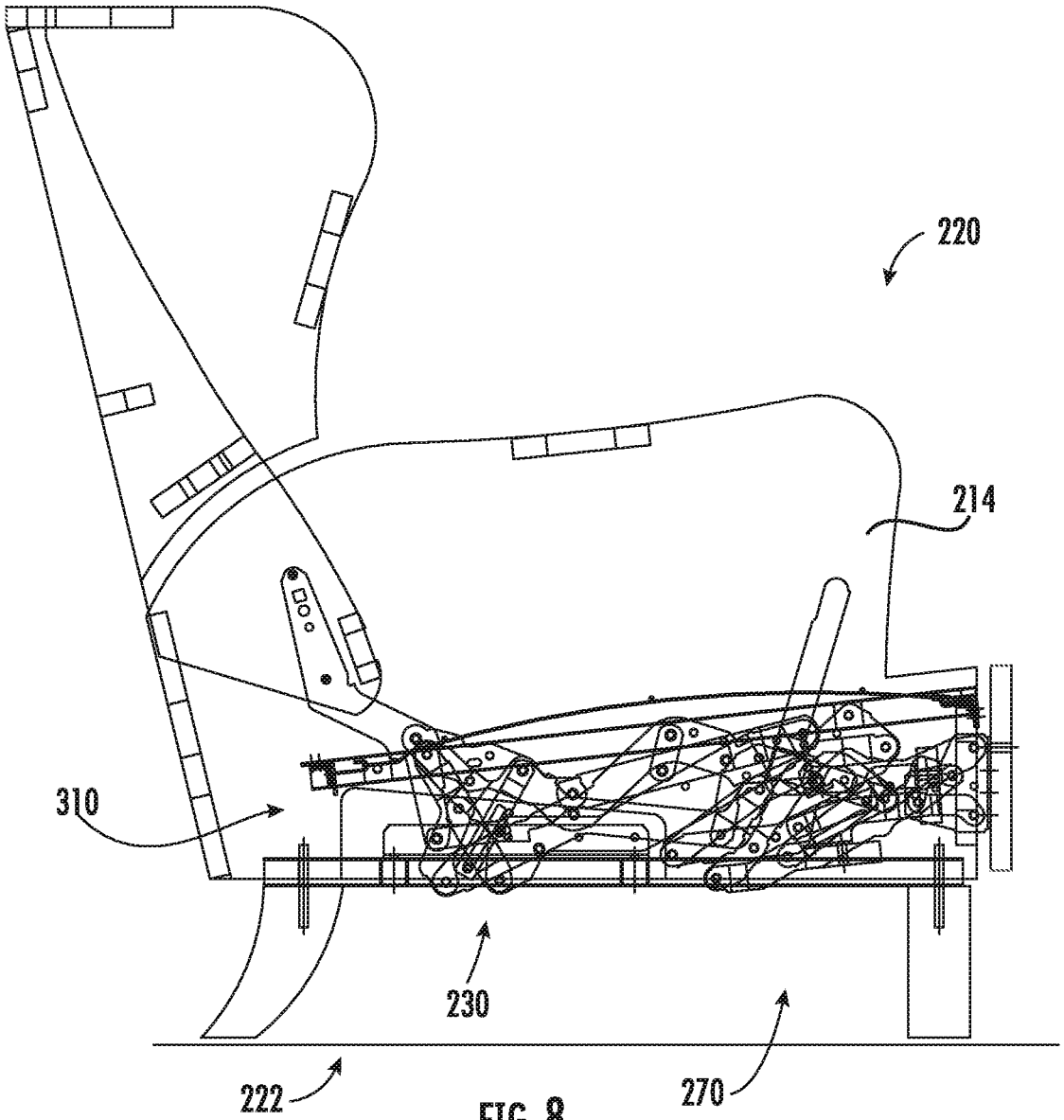
FIG. 8 is a side view of a high-leg reclining chair according to additional embodiments of the invention shown in the upright position.
Figure 9:
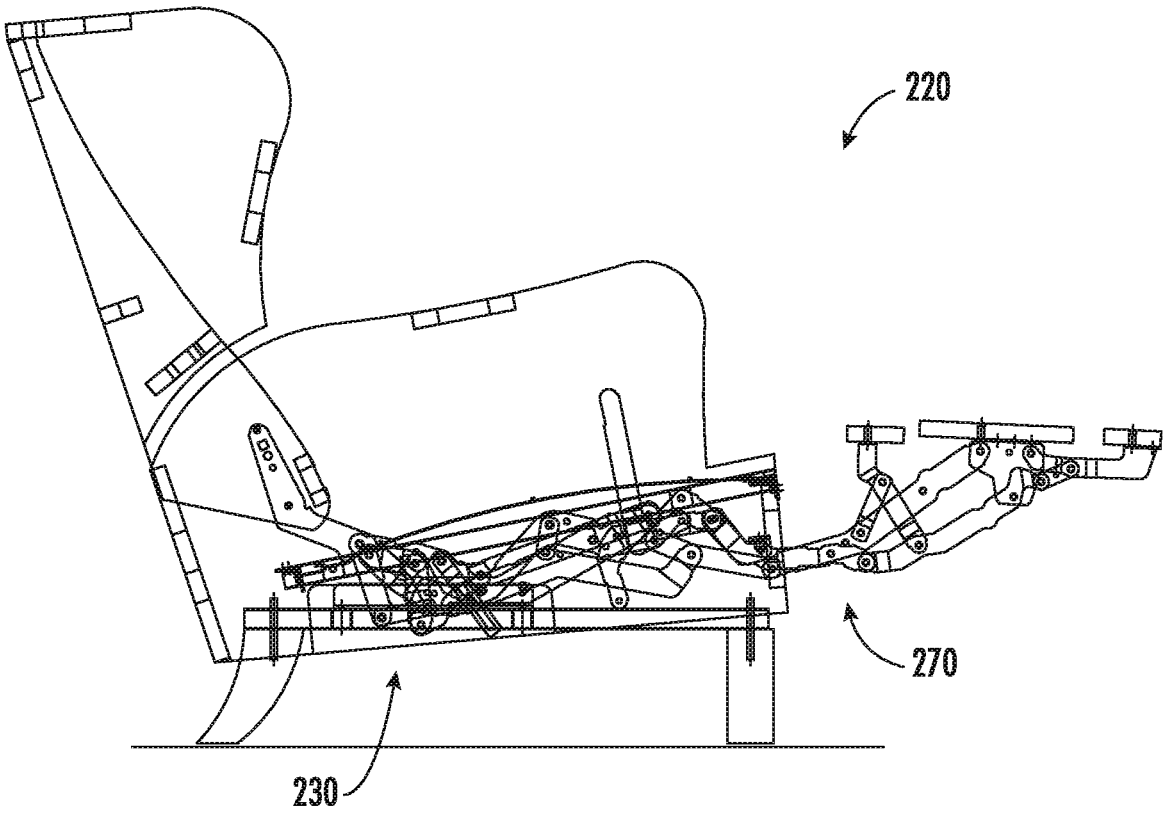
FIG. 9 is a side view of the chair of FIG. 8 shown in the TV position.

Referring now to the figures, a reclining chair, designated broadly at 20, is shown in FIGS. 1-7. The chair 20 includes a base 22, a seat 110, a backrest 130, inner, main and outer ottomans 140*a*, 140*b*, 140*c*, a pair of reclining mechanisms 30, and a pair of footrest mechanisms 70. The seat 110, the backrest 130, and the inner, main and outer ottomans 140*a*, 140*b*, 140*c* are moved via the reclining mechanisms 30 and footrest mechanisms 70 between an upright position (FIGS. 1, 4 and 5), an intermediate TV position (FIGS. 2 and 6), and a fully reclined position (FIGS. 3 and 7). These components are described in greater detail below.

Figure 4:
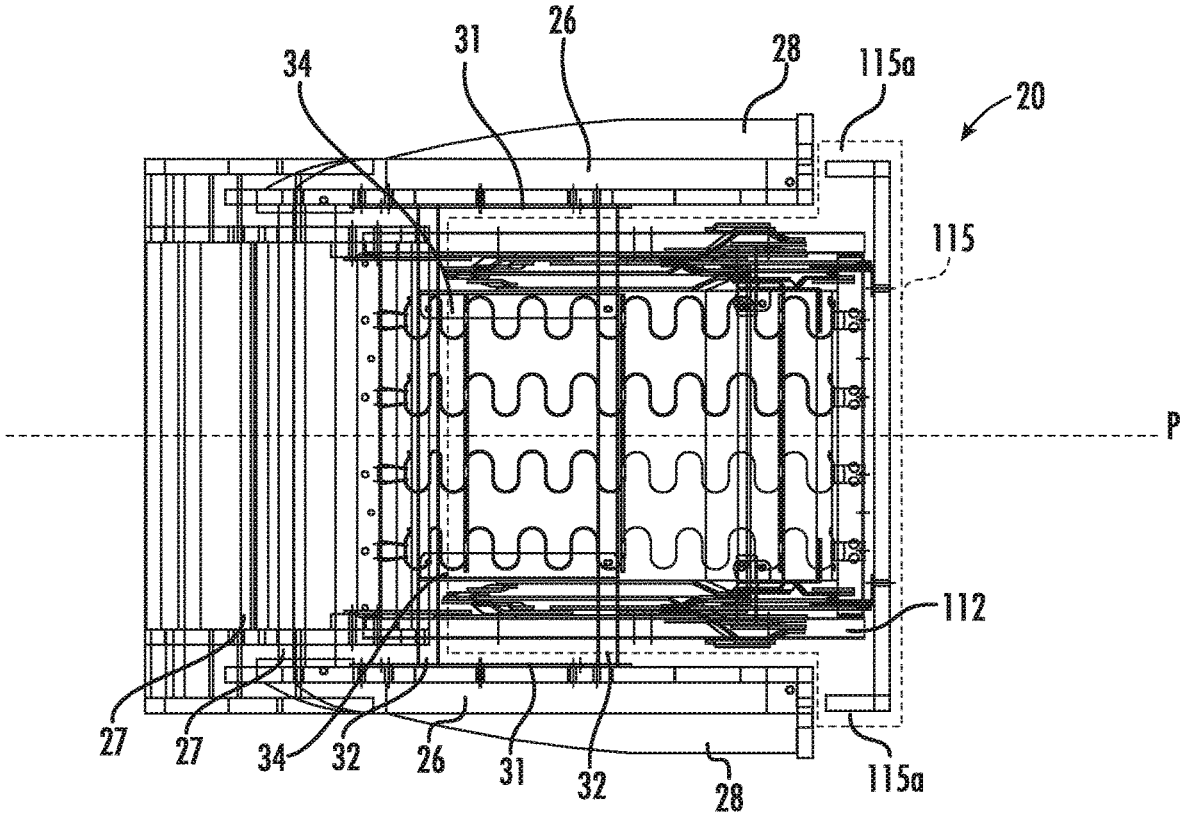
FIG. 4 is a top view of the chair of FIG. 1 shown with the backrest shown in a reclined position and the footrests shown in an extended position.

Referring to FIGS. 1 and 4, the base 22 includes four legs 24 mounted to two longitudinal rails 26. Arms 28 are mounted atop the rails 26. Cross-members 27 extend between the rear portions of the arms 28. The leas 24 are typically sized so that the remainder of the base 22 rests between about 4 and 9 inches above the ground or other underlying surface, such that the chair is a "high leg"-style chair. Mounting plates 31 are mounted to the inner surface of each arm 28. Cross-members 32 are fixed to and extend transversely between the mounting plates 31. Two mounting rails 34 are mounted atop the cross-members 32.

The seat 110 includes a generally rectangular seat frame 112 that underlies a cushion (not shown). A serpentine seat adapter 114 is mounted to each side of the seat frame 112. A T-cushion 115 with wings 115*a* rests on and above the seat frame 112 (see FIGS. 1 and 4).

The reclining mechanisms 30 are mirror images of each other about a vertical plane P that bisects the chair 20 between the arms 28 (see FIG. 4); as such, only one reclining mechanism 30 will be described herein, with the understanding that the description is equally applicable to the reclining mechanism 30 mounted on the opposite side of the chair 20. Also, the reclining mechanism 30 will be described first in the reclined position of FIGS. 3 and 7 for clarity.

The reclining mechanism 30 is mounted to the base 22 via a mounting bracket 36 that is fixed to the mounting rail 34. A coupling link 38 is attached to the forward end of the mounting bracket 36 at a pivot 40. A three-fingered transition plate 42 is attached at its forward end to the rear end of the coupling link 38 at a pivot 44, and at a central portion to the seat adapter at a pivot 45. A short control link 46 extends upwardly from a pivot 48 with the mounting bracket 36. A tripartite transition link 50 is attached at its rear end to the rearmost finger of the transition plate 42 at a pivot 51 and at a central location to the upper end of the control link 46 at a pivot 52.

A short drawing link 54 is attached at its forward end to the lower portion of the transition plate 42 at a pivot 56. At its opposite end, the drawing link 54 is attached to the lower end of a backpost 58 at a pivot 60. The opposite upper end of the backpost 58 is fixed to the backrest 130. A central portion of the backpost 58 is attached to the seat adapter 114 at a pivot 61. A slide link 62 is attached at its upper end to the seat adapter 114 at the pivot 45; at its lower end, the slide link 62 includes a slot 62*a* that receives a pin 66*a* extending from a connecting link 66. The connecting link 66 is attached to the forward end of the transition link 50 at a pivot 68 and extends forwardly therefrom to attach to the footrest mechanism 70 as described below.

The footrest mechanism 70 includes an upper ottoman swing link 72 that is attached to the forward end of the seat adapter 114 at a pivot 74, and a lower ottoman swing link 76 that is attached to seat adapter 114 at a pivot 78. The lower ottoman swing link is also attached to the forward end of the connecting link 66 at a pivot 77. An upper ottoman extension link 80 is attached at its rear end to the lower ottoman swing link 76 at a pivot 82, and is also attached to the upper ottoman swing link 72 at a pivot 83. A lower ottoman extension link 84 is attached to the forward end of the upper ottoman swing link 72 at a pivot 86. Each of the upper and lower ottoman extension links 80, 84 is attached to a main ottoman bracket 96 at pivots 97, 98 respectively. The main ottoman bracket 96 supports the main ottoman 140*b*.

An inner ottoman bracket 88 is attached to the lower ottoman extension link 84 at a pivot 90 and extends upwardly and slightly rearwardly therefrom. A brace 92 is attached to the inner ottoman bracket 88 at a pivot 93 and to the upper ottoman extension link 80 at a pivot 94. The inner ottoman bracket 88 supports the inner ottoman 140*a* from underneath.

An outer ottoman bracket 100 is attached to the main ottoman bracket 96 at a pivot 103 and extends forwardly therefrom. A control link 104 extends from a pivot 105 with the forward end of the lower ottoman extension link 84 to a pivot 106 with the outer ottoman bracket 100. The outer ottoman bracket 100 supports the outer ottoman 140*c*.

The footrest mechanism 70 includes an L-shaped handle 116 that is used to extend the ottomans 140*a*, 140*b*, 140*c*. The handle 116 includes an extension 118 that extends rearwardly, then downwardly, from the shorter "leg" of the handle 116, and also extends slightly forwardly of the shorter "leg." The forward end of the extension 118 is attached to a drive link 120 at a pivot 122. At its opposite end, the drive link 120 is attached to the upper ottoman swing link 72 at a pivot 124. The rear end of the extension 118 is attached to the seat adapter 114 at a pivot 126.

Referring now to FIGS. 1 and 5, therein the chair 20 is shown in its fully upright position, with the seat 110 generally horizontally disposed, the backrest 130 generally vertically disposed at a first backrest angle $\alpha$, and the ottomans 140*a*, 140*b*, 140*c* retraced, with the main ottoman 140*b* generally vertically disposed in front of the base 22 and below the seat 110, the inner ottoman 140*a* generally vertically disposed and positioned just behind the main ottoman 140*b*, and the outer ottoman 140*c* inverted and positioned rearwardly of the inner ottoman 140*a*. A pantographic linkage formed by the upper and lower ottoman swing links 72, 76 and the upper and lower ottoman extension links 80, 84 is folded under the seat frame 112. The handle 116 is tilted forward about the pivot 126, such that the drive link 120 partially overlies the forward end of the extension 118.

Also, in the upright position, the slide link 62 and the transition link 50 are oriented with their forward ends (which are attached to the transition plate 42) above their lower ends, with the pin 66*a* of the connecting link 66 located at the lower end of the slot 62*a*. As a result, the pitch angle $\beta$ of the seat 110 is relatively shallow (about 3 to 9 degrees) compared to the underlying surface.

It is also notable that, in this position, the forward portion of the seat frame 112 extends slightly in front of the arms 28. As such, the T-cushion 115 can rest on the seat frame 112 with the "ears" of the T-cushion 115 positioned in front of the arms 28.

It is also notable that, in the upright position, the difference in elevation between the lowermost portion of the reclining and footrest mechanisms 30, 70 (represented by the connecting link 66 and the transition link 50) and the uppermost portion of the seat frame 112 is between about 5 and 7 inches. Because the mechanisms 30, 70 fold into such a small vertical package, the mechanisms 30, 70 are suitable for use with a high leg chair like that shown herein.

To move the chair 20 from the upright position of FIG. 1 to the TV position of FIG. 2, the occupant of the chair 20 grasps the handle 116 and pulls rearwardly. This motion rotates the handle 116 and extension 118 about the pivot 126 (rotation is counterclockwise from the vantage point of FIGS. 1 and 5). Rotation of the handle 116 draws the forward end of the drive link 120 upwardly, which in turn drives the upper ottoman swing link 72 counterclockwise about the pivot 74. This motion forces the upper ottoman extension link 80 forward, thereby drawing the lower ottoman swing link counterclockwise about the pivot 78. Rotation of the lower ottoman swing link 76 forces the lower ottoman extension link 84 forward. As the upper and lower ottoman extension links 80, 84 move forwardly, they also separate from each other slightly, which causes (a) the inner ottoman bracket 88 to rotate counterclockwise relative to the lower ottoman extension link 84 to present the inner ottoman 140*a* in a horizontal orientation, and (b) the main ottoman bracket 96 to rotate counterclockwise relative to the base 22 to orient the main ottoman 140*b* horizontally. Extension of the lower ottoman extension link 84 also forces the control link 104 forwardly, which drives the outer ottoman bracket 100 counterclockwise relative to the main ottoman bracket 96 to present the outer ottoman 140*c* in a horizontal orientation.

Also, the forward movement of the lower ottoman swing link 76 draws the connecting link 66 forward. The motion of the connecting link 66 rotates the slide link 62 counterclockwise about the pivot 64, and also draws the transition link 50 counterclockwise about the pivot 51. These movements draw the transition plate 42 downwardly (controlled by the control link 46). The lowering of the transition plate 42 draws the rear end of the seat 110 lower, thereby increasing the pitch angle δ of the seat 110 (typically to an angle of between about 6 and 12 degrees). This movement also draws the backpost 58 and backrest 130 lower and may tilt the backrest 130 very slightly, although the backrest 130 substantially maintains the first backrest angle α.

As can be seen in FIGS. 2 and 6, the forward end of the seat 110 remains in front of the arms 28, with little forward or rearward movement. Typically, the forward end of the seat 110 moves no more than 0.25 inch forward or rearward. As such, a T-cushion placed on the seat 110 can remain properly positioned in place in the TV position.

To move the chair 20 to the reclined position of FIGS. 3 and 7 from the TV position of FIGS. 2 and 6, the occupant of the chair 20 pushes on the arms 28 to press his back into the backrest 130. The force on the backrest 130 rotates the backpost 58 counterclockwise about the pivot 61 to enable the backrest 130 to recline relative to horizontal at a second backrest angle θ. Also, as the lower end of the backpost 58 rises, it forces the drawing link 54 forwardly and upwardly, which drives the transition plate 42 and the seat adapter 114 (and in turn the seat 110) upwardly.

In the frilly reclined position of FIG. 3, the forward portion of the seat frame 112 remains in front of the arms 28 and moves very little forwardly or rearwardly (typically no more than about 0.5 inch) to properly receive and support a T-cushion.

Referring now to FIGS. 8-14, another embodiment of a high-leg reclining chair, designated broadly at 220, is shown therein. The chair 220 employs similar reclining and footrest mechanisms 230, 270 to the reclining and footrest mechanisms 30, 70 discussed above and shown in FIGS. 1-7. However, the chair 220 is configured such that the seat 310 and arms 214 are fixed relative to each other, such that during movement of the chair 220, the seat 310 and arms 214 move together relative to the base 222.

Figure 10:
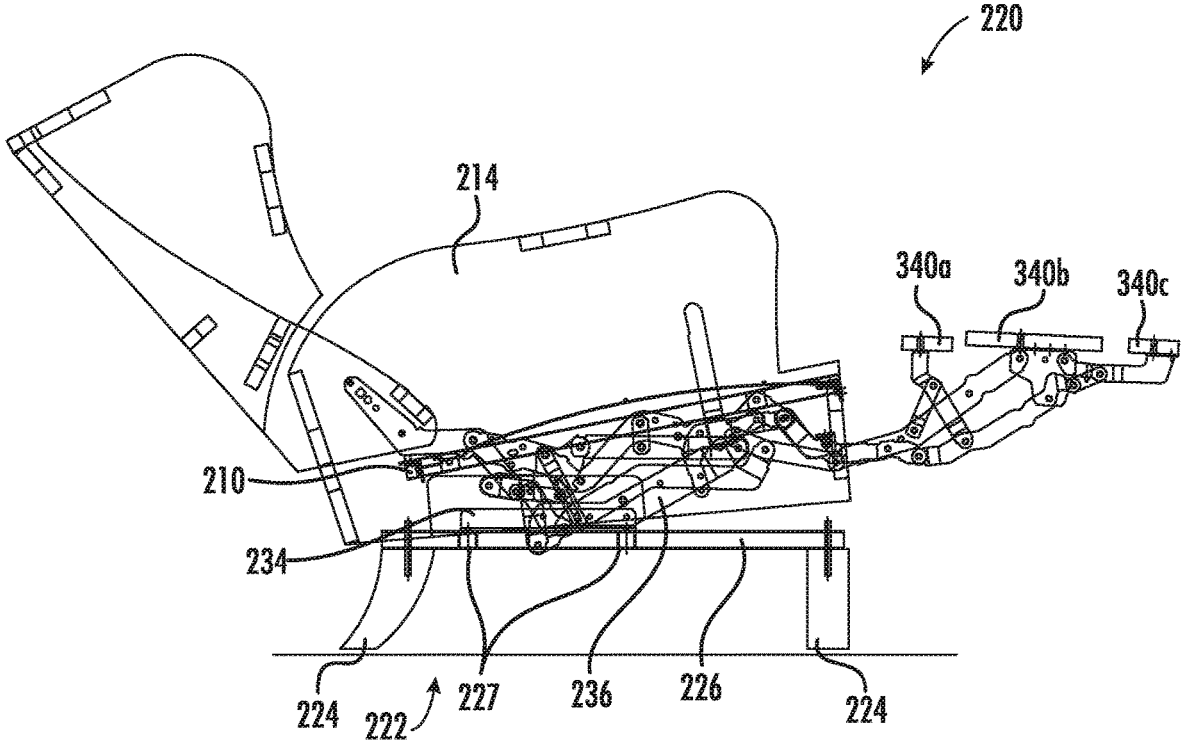
FIG. 10 is a side view of the chair of FIG. 8 shown in the fully reclined position.
Figure 11:
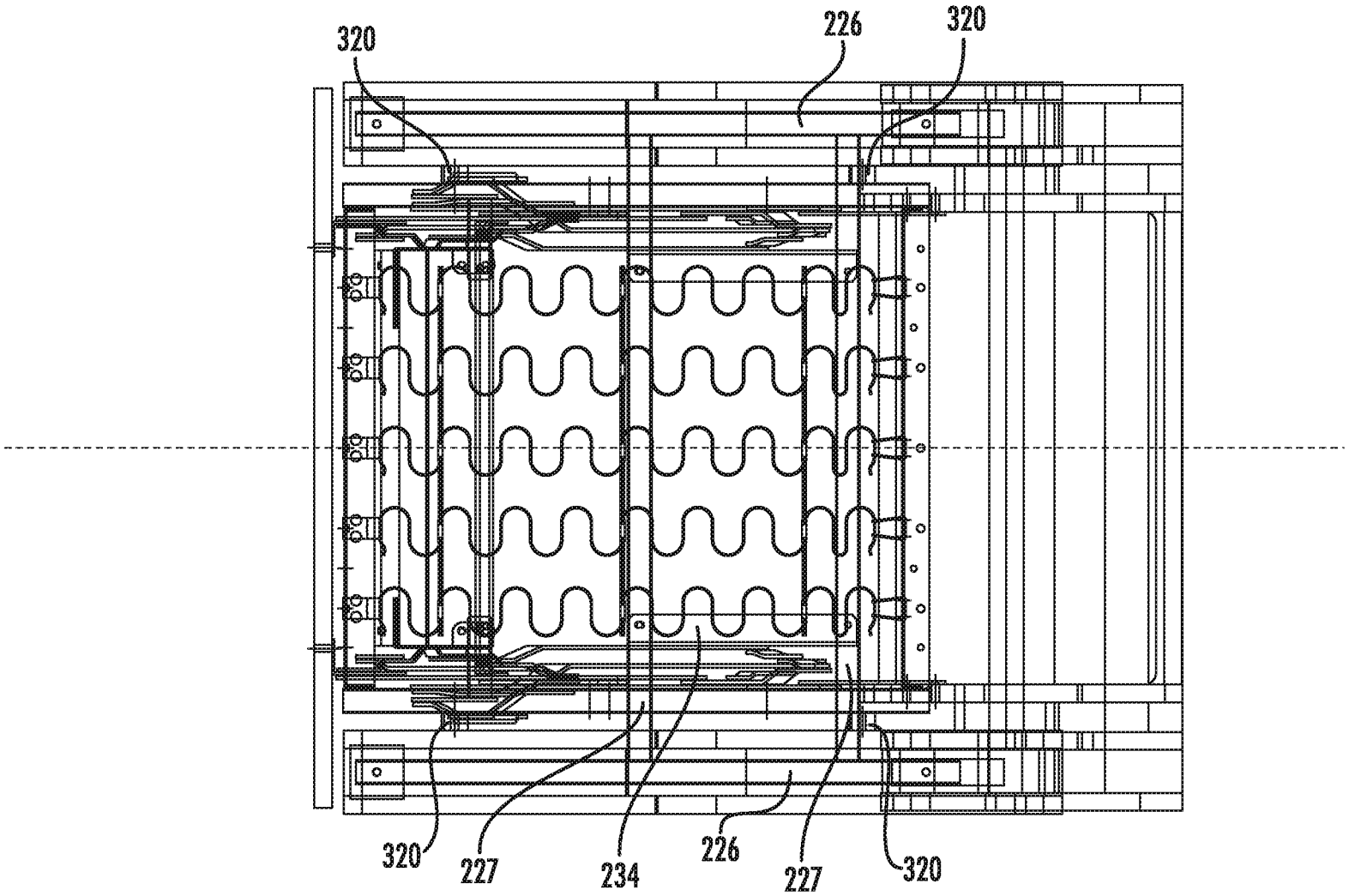
FIG. 11 is a top view of the chair of FIG. 8 shown with the backrest shown in a reclined position and the footrests shown in an extended position.
Figure 12:
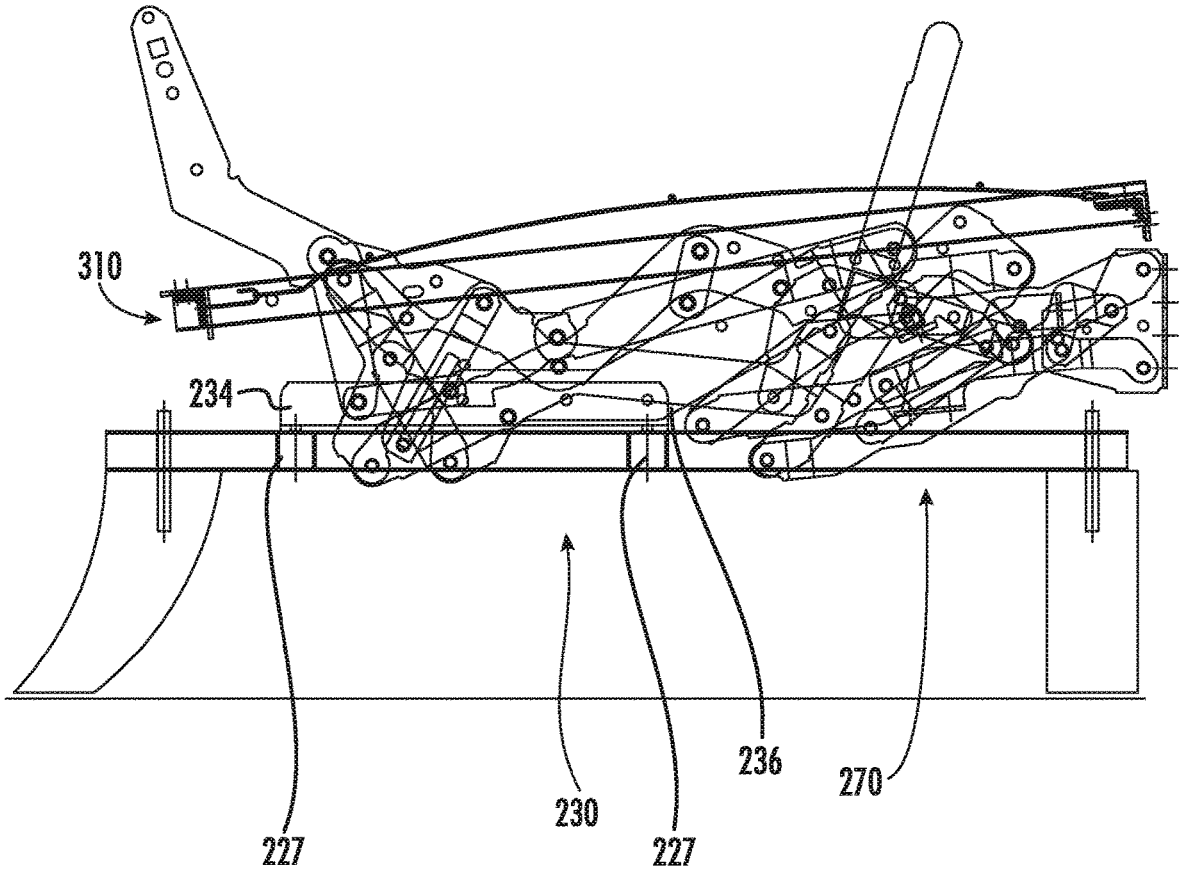
FIG. 12 is a side view of the reclining and footrest mechanisms of the seating unit of FIG. 8 shown in the upright position.
Figure 13:
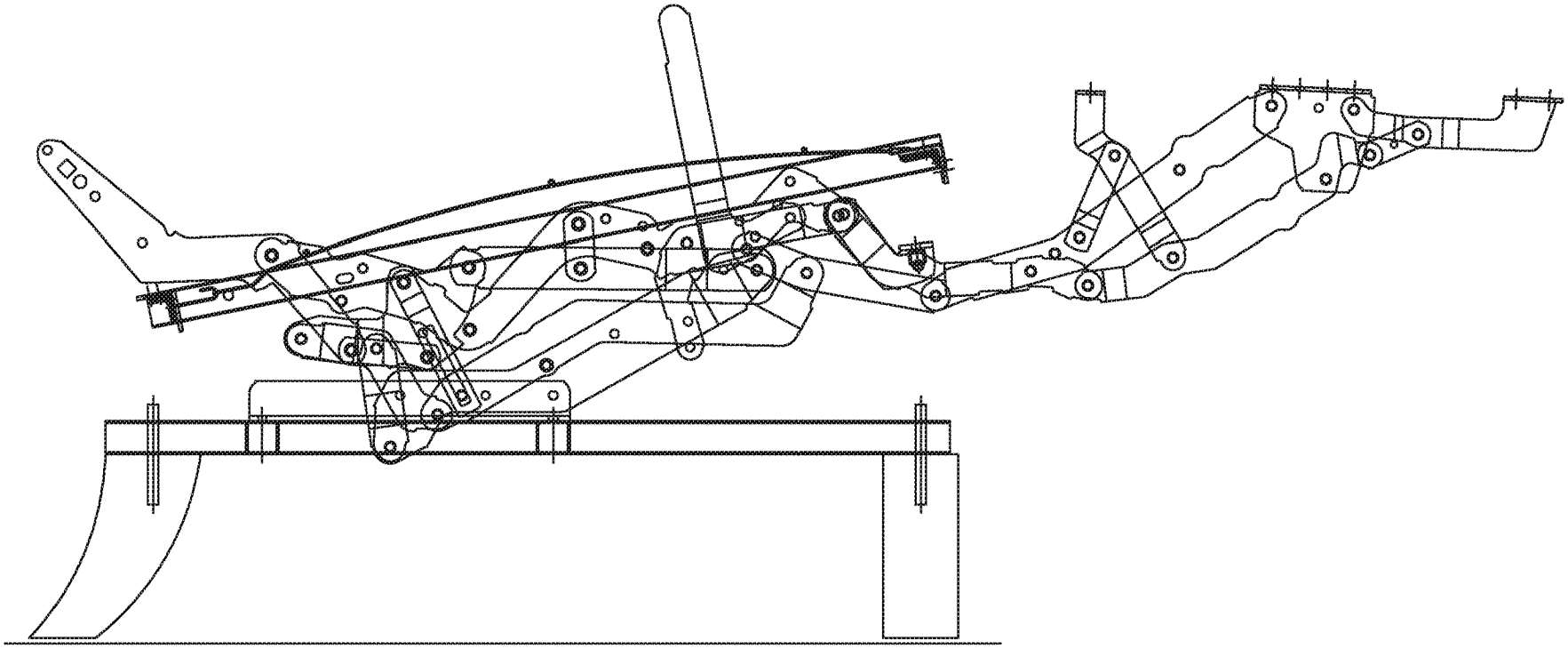
FIG. 13 is a side view of the reclining and footrest mechanisms of the seating unit of FIG. 8 shown in the TV position.
Figure 14:
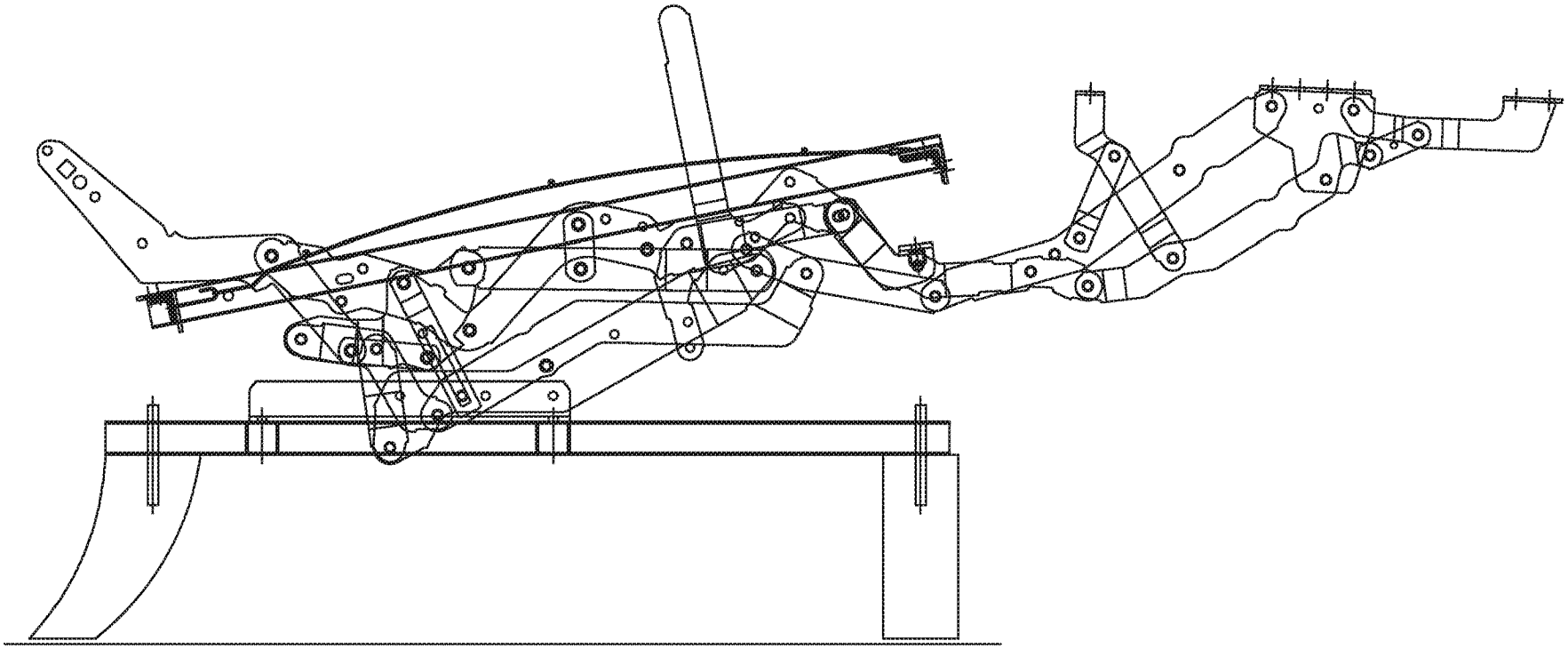
FIG. 14 is a side view of the reclining and footrest mechanisms of the seating unit of of FIG. 8 shown in the fully reclined position.

As can be seen in FIGS. 10 and 11, the base 222 has rails 226 mounted to the legs 224. Cross-members 227 are fixed to the rails 226. The mounting brackets 236 of the reclining mechanisms 230 are mounted atop the cross-members 227 via angled rails 234. The remainder of the reclining mechanisms 230 and footrest mechanisms 270 are similar to the reclining mechanisms 30 and footrest mechanisms 70 discussed above and attach to the seat 310, backrest 330 and ottomans 340*a*, 340*b*, 340*c* as discussed above. The seat 310 is fixed to the arms 214 via shims 320 extending between the seat frame 312 and the inner surfaces of the arms 214. As a result, when the chair 210 is moved from the upright position of FIGS. 8 and 12 to the TV position of FIGS. 9 and 13, the arms 214 tip rearwardly to the same degree as the seat 310 changes its pitch angle.

Figure 15:
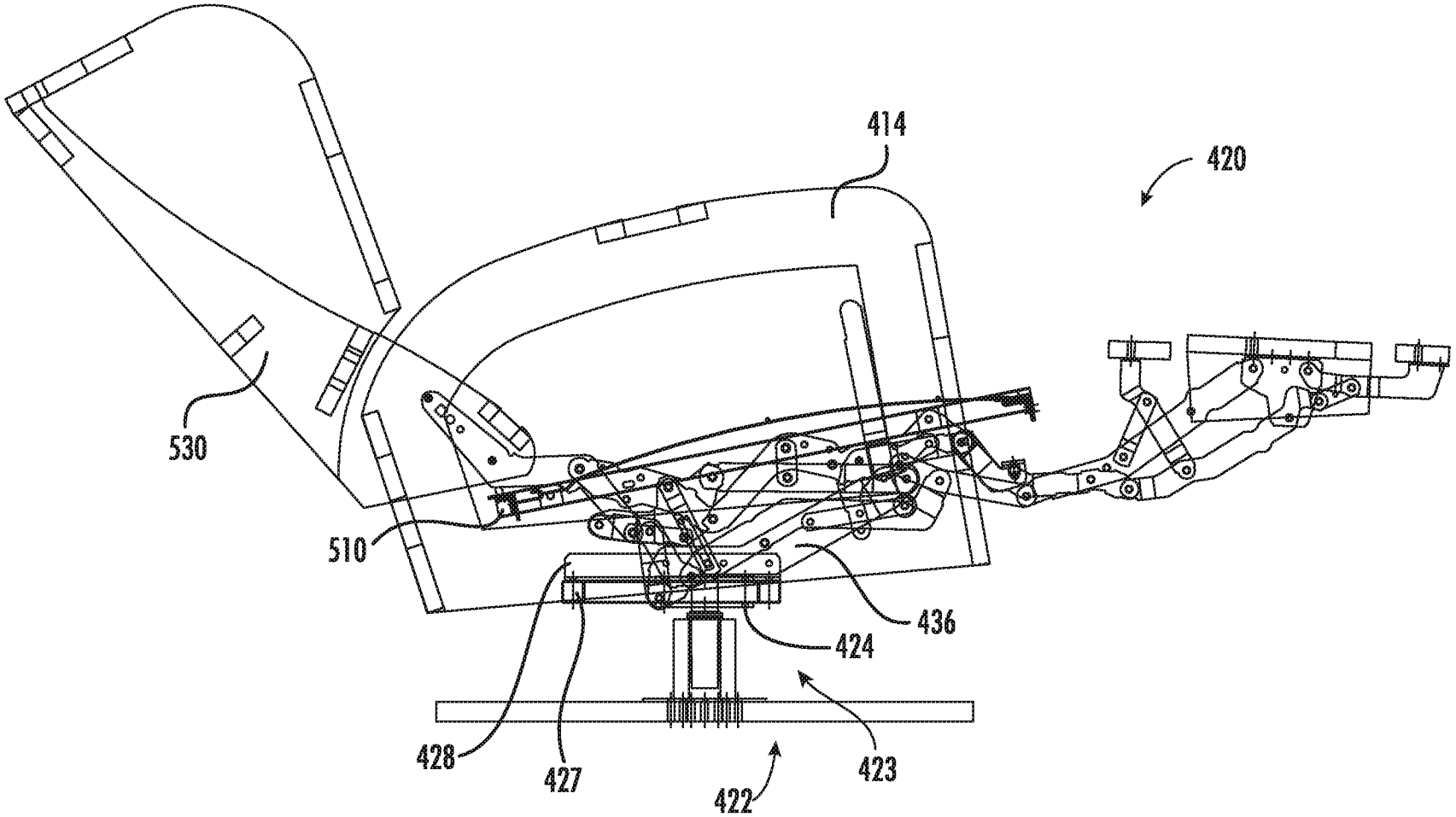
FIG. 15 is a side view of a swiveling reclining chair according to additional embodiments of the invention shown in the fully reclined position.

Referring now to FIG. 15, another reclining chair, designated broadly at 420, is shown therein. The chair 420 has a base 422 with a swivel unit 423 of conventional design. The upper hub of the swivel unit 423 is fixed to a plate 424 to which cross-members 427 are mounted. Rails 428 are mounted on the cross-members 427. Angled rails 434 and mounting brackets 436 of the reclining members 430 are then mounted on the rails 428, and the remainder of the reclining mechanisms 430 are mounted in the mounting brackets 436, the seat 510 and the backrest 530 in the manner discussed above. As with the chair 220, the seat 510 of the chair 420 is fixed relative to the arms 414, such that the arms 414 move with the seat 510 in moving between the upright, TV and reclined positions. As such, the chair 410 has not only reclining capability, but also a swiveling capacity. With the swivel unit, the arms of the chair 420 are typically elevated off of the floor not unlike a high leg chair such as chairs 20, 220 discussed above. As used herein, the term "elevated mount chair" is intended to refer to high leg chairs, swivel chairs, and the like in which the arms of the chair are at least 4 inches from the floor, thereby necessitating a vertically compact reclining mechanism.

Figure 16:
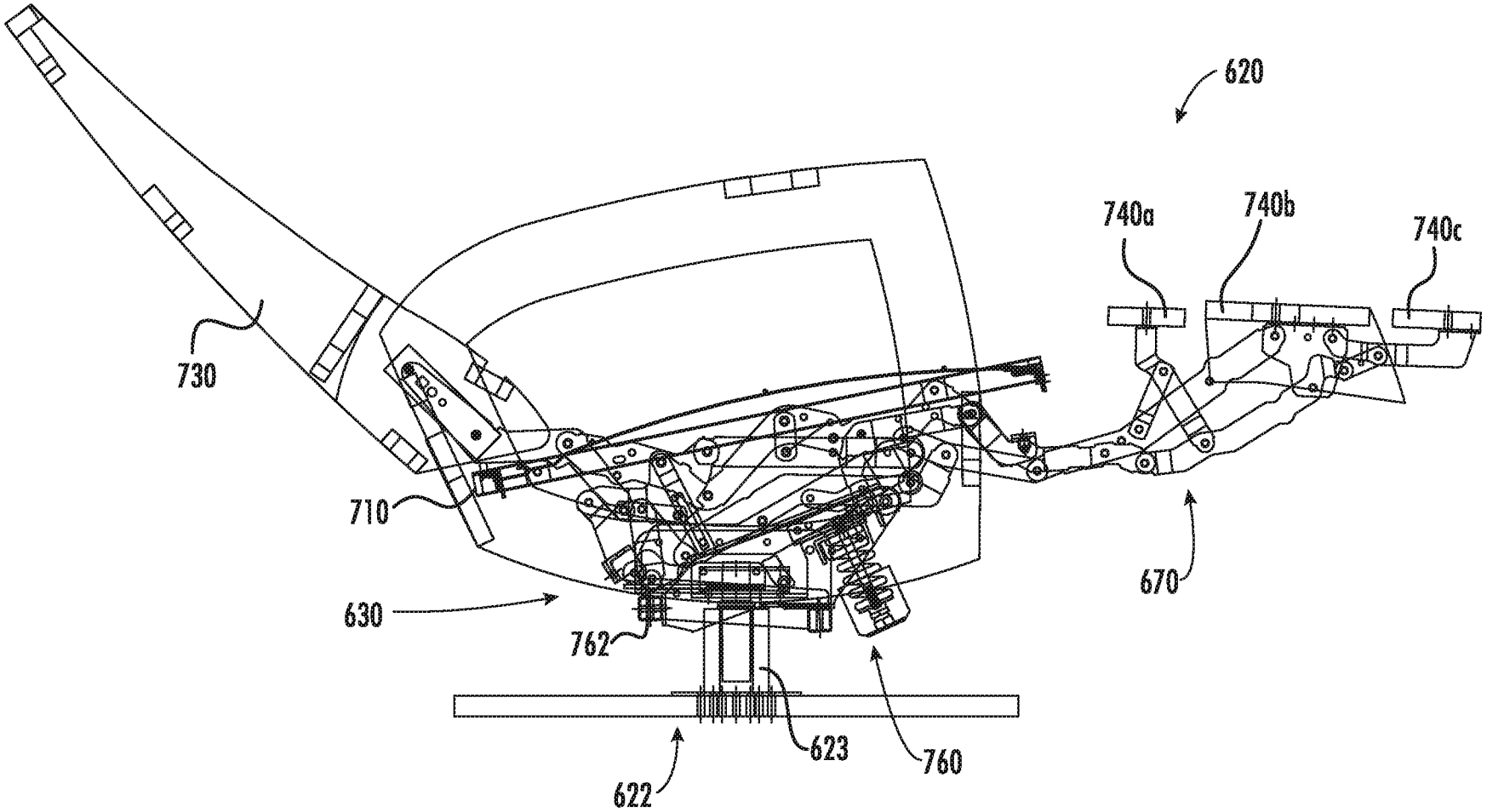
FIG. 16 is a side view of a swiveling, rocking reclining chair according to additional embodiments of the invention shown in the fully reclined position.

Referring now to FIG. 16, another reclining chair, designated broadly at 620, is shown therein. The chair 620 has a base 622 with a swivel unit 623 as discussed above, but also has a rocking unit 760 mounted on the swivel unit 623. The configuration of the rocking unit 623 is discussed at length in U.S. Pat. No. 8,911,009, the disclosure of which is hereby incorporated herein in its entirety. The reclining mechanisms 630 of the chair 620 are mounted to lateral plates 762 of the rocking unit 760 and to the seat 710 and backrest 730 of the chair 610. The footrest mechanisms 670 are mounted to the seat and ottomans 740*a*, 740*b*, 740*c* in the manner discussed above. Thus, the chair 610 has reclining, swiveling and rocking capability, all in an elevated mount chair with a T-cushion for the seat.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An elevated mount chair; comprising:

a base;

a pair of arms;

a seat positioned above the base between the arms;

a backrest;

a first ottoman;

a reclining mechanism attached to the base, the seat and the backrest; and a footrest mechanism attached to the seat and the first ottoman, the footrest mechanism being coupled to the reclining mechanism;

wherein the seat includes a T-cushion positioned above a seat frame, the T-cushion having lateral wings that are positioned forward of the arms;

wherein the reclining and footrest mechanisms comprise a plurality of pivotally interconnected links configured to move the chair between (a) an upright position, in which the backrest is disposed at a first generally upright backrest angle, the seat is disposed at a first generally horizontal seat angle, and the first ottoman is retracted below a forward portion of the seat, (b) a TV position, in which the backrest substantially maintains the first backrest angle, the seat is disposed at a second seat angle that is steeper than the first seat angle; and the first ottoman is extended in front of the seat and is generally horizontally disposed, and (c) a frilly reclined position, in which the backrest is disposed at a second backrest angle that is shallower than the first backrest angle, and the first ottoman remains extended in front of the seat;

wherein, in moving between the upright, TV and fully reclined positions, a front portion of the seat experiences substantially no forward or rearward movement relative to the arms; and wherein the arms are fixed relative to the base, and the seat is movable relative to the arms.

2. The chair defined in claim 1, wherein in the upright position, a lowermost portion of the reclining and footrest mechanisms is between about 5 and 7 inches from an uppermost portion of the seat frame.

3. The chair defined in claim 1, wherein the base includes a swivel unit.

4. The chair defined in claim 1, wherein the base includes a rocking unit.

5. The chair defined in claim 1, further comprising a second ottoman that moves from a retracted position beneath the seat to an extended position in front of the seat when the chair moves from the upright position to the TV position.

6. The chair defined in claim 1, wherein the backrest is pivotally attached directly to the seat at a single pivot.

7. An elevated mount chair; comprising:

a base;

a pair of arms;

a seat positioned above the base between the arms;

a backrest;

a first ottoman;

a reclining mechanism attached to the base, the seat and the backrest; and a footrest mechanism attached to the seat and the first ottoman, the footrest mechanism being coupled to the reclining mechanism;

wherein the seat includes a T-cushion positioned above a seat frame, the T-cushion having lateral wings that are positioned forward of the arms;

wherein the reclining and footrest mechanisms comprise a plurality of pivotally interconnected links configured to move the chair between (a) an upright position, in which the backrest is disposed at a first generally upright backrest angle, the seat is disposed at a first generally horizontal seat angle, and the first ottoman is retracted below a forward portion of the seat, (b) a TV position, in which the backrest substantially maintains the first backrest angle, the seat is disposed at a second seat angle that is steeper than the first seat angle; and the first ottoman is extended in front of the seat and is generally horizontally disposed, and (c) a fully reclined position, in which the backrest is disposed at a second backrest angle that is shallower than the first backrest angle, and the first ottoman remains extended in front of the seat;

wherein in the upright position, a lowermost portion of the reclining and footrest mechanisms is between about 5 and 7 inches from an uppermost portion of the seat frame.

8. The chair defined in claim 7, wherein the arms are fixed relative to the base, and the seat is movable relative to the arms.

9. The chair defined in claim 7, wherein the base includes a swivel unit.

10. The chair defined in claim 7, wherein the base includes a rocking unit.

11. The chair defined in claim 7, further comprising a second ottoman that moves from a retracted position beneath the seat to an extended position in front of the seat when the chair moves from the upright position to the TV position.

12. An elevated mount chair; comprising:

a base;

a pair of arms;

a seat positioned above the base between the arms;

a backrest;

a first ottoman;

a reclining mechanism attached to the base, the seat and the backrest; and a footrest mechanism attached to the seat and the first ottoman, the footrest mechanism being coupled to the reclining mechanism;

wherein the seat includes a T-cushion positioned above a seat frame, the T-cushion having lateral wings that are positioned forward of the arms;

wherein the reclining and footrest mechanisms comprise a plurality of pivotally interconnected links configured to move the chair between (a) an upright position, in which the backrest is disposed at a first generally upright backrest angle, the seat is disposed at a first generally horizontal seat angle, and the first ottoman is retracted below a forward portion of the seat, (b) a TV position, in which the backrest substantially maintains the first backrest angle, the seat is disposed at a second seat angle that is steeper than the first seat angle; and the first ottoman is extended in front of the seat and is generally horizontally disposed, and (c) a fully reclined position, in which the backrest is disposed at a second backrest angle that is shallower than the first backrest angle, and the first ottoman remains extended in front of the seat;

wherein in the upright position, a lowermost portion of the reclining and footrest mechanisms is between about 5 and 7 inches from an uppermost portion of the seat frame; and wherein the backrest is pivotally attached directly to the seat at a single pivot.

* * * * *